US005207042A

United States Patent [19]

Molinar

[11] Patent Number: 5,207,042

[45] Date of Patent: May 4, 1993

[54] STUDLESS BUILDING STRUCTURE

[76] Inventor: Raoul G. Molinar, 279 N. Locust Ave., Agoura, Calif. 91301

[21] Appl. No.: 712,254

[22] Filed: Jun. 7, 1991

[51] Int. Cl.[5] ..... E04B 2/02; E02D 27/00

[52] U.S. Cl. ..... 52/293.1; 52/274; 52/587; 52/92.1

[58] Field of Search ..... 52/220, 221, 234, 236.1, 52/293, 587, 274, 272, 780, 283, 289, 90

[56] References Cited

U.S. PATENT DOCUMENTS

| | | | |
|---|---|---|---|
| 983,597 | 2/1911 | Andrew | 52/780 |
| 996,262 | 6/1911 | Kurtz | 52/714 |
| 1,825,195 | 9/1931 | McAvoy et al. | 52/275 |
| 2,117,934 | 5/1983 | Bemis | 52/234 |
| 2,133,621 | 10/1938 | Klein | 52/272 |
| 2,226,332 | 12/1940 | Bacci | 52/578 |
| 2,308,248 | 1/1943 | Rehn | 52/289 |
| 2,372,768 | 4/1945 | Davison | 52/289 |
| 2,438,604 | 2/1948 | Gogerty | 52/289 |
| 3,236,014 | 2/1966 | Edgar | 52/92 |
| 3,369,335 | 2/1968 | Smith | 52/270 |
| 3,462,897 | 8/1969 | Weinrott | 52/169.14 |
| 3,529,389 | 9/1970 | Wilkins | 52/221 |
| 3,712,004 | 1/1973 | Loebsack | 52/265 |
| 4,455,801 | 6/1984 | Merritt | 52/309.9 |
| 4,628,650 | 12/1986 | Parker | 52/265 |
| 4,630,418 | 12/1986 | Degut | 52/264 |

FOREIGN PATENT DOCUMENTS

| | | | |
|---|---|---|---|
| 290490 | 5/1926 | United Kingdom | 52/234 |

*Primary Examiner*—James L. Ridgill, Jr.
*Attorney, Agent, or Firm*—Sheldon & Mak

[57] ABSTRACT

Disclosed is a modular construction system that includes a base foundation having pairs of anchor straps molded therein for defining intersecting vertical wall mounting surfaces and attachment points. A plurality of panels connect between pairs of the attachment points and extend upwardly therefrom, one side of each panel being coplanar with a corresponding one of the mounting surfaces, adjacent coplanar pairs of the panels being connected by a plate that extends in line with top peripheral extremities of the panels. Adjacent sides of the panels have a tongue-and-groove configuration between the panel surfaces for holding the panel sides aligned each other in a direction normal to the panel surfaces. Angle brackets connect adjacent pairs of coplanar panels at intersecting pairs of the mounting surfaces. Joists connect between spaced pairs of the plates. A slot formed between the plate and a cap that is fastened to top portions of the walls opposite the panels from the plates can support panels of second story walls. Rigid insulation panels are easily installed with covering wall board members for forming a voidless wall configuration. Installation of electrical power circuitry is simplified by mounting outlet boxes directly to the structural panels, with power cables running in grooves that are formed in the insulation, being retained by the wall board.

17 Claims, 6 Drawing Sheets

FIG. 13.
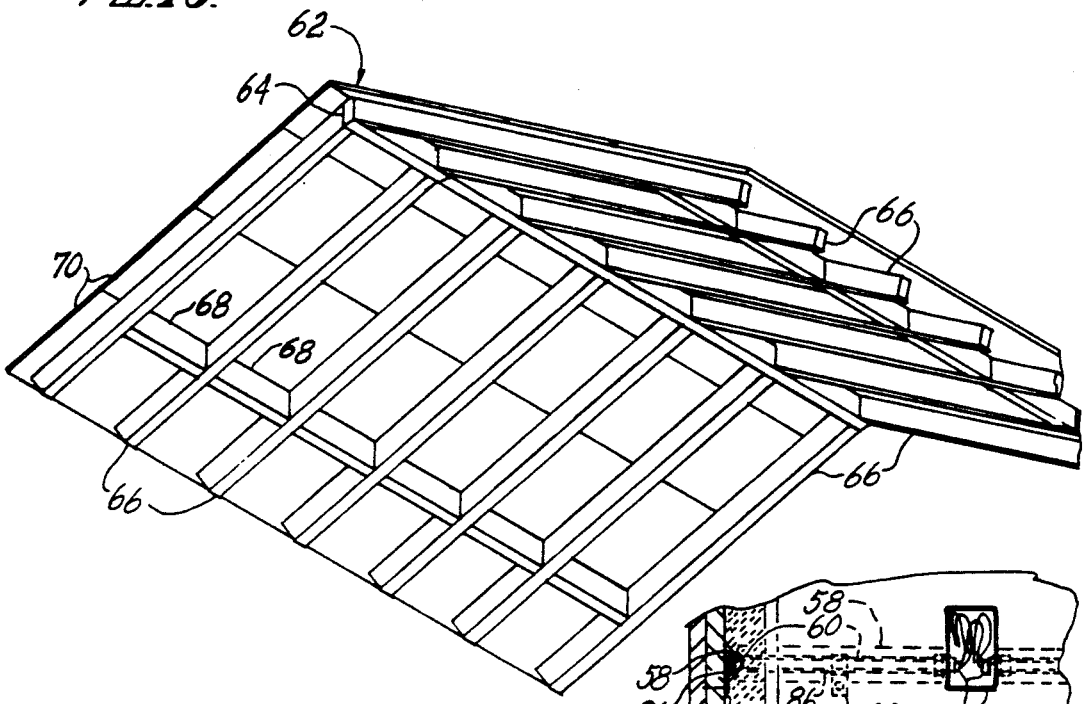
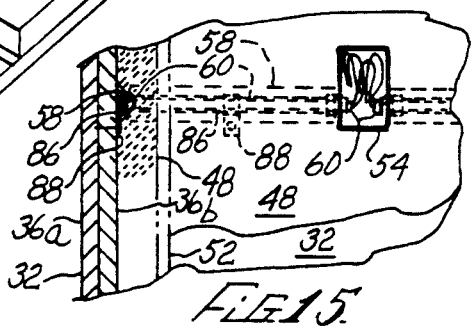
FIG. 15.
FIG. 11.
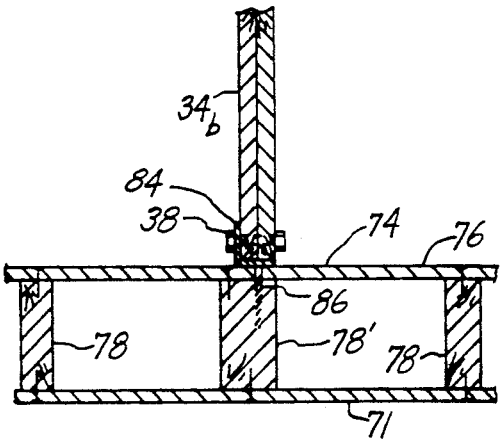
FIG. 12.
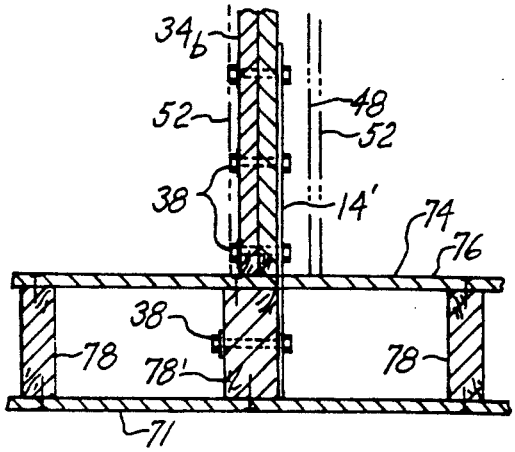

STUDLESS BUILDING STRUCTURE

BACKGROUND

The present invention relates to building structures such as for dwellings and the like, and more particularly to modular forms of such structures.

One method for constructing a building is by means of conventional frame construction. The framing, formed with studs, sill and roof plates, joists, and rafters, is cut to fit and nailed together on the job site. Usually outside and inside wall coverings are added to the framing. It is common for the outside wall covering to be put in place before the wall is stood up. One disadvantage of frame construction is that the labor for framing is expensive. Also, framing is inefficient to the extent that holes have to be cut for electrical and plumbing fixtures, the holes often significantly weakening the framing. Further, when the wall coverings are put up, there is a danger of nailing into the plumbing and wiring runs, with consequences of water leaks and electrical short circuits.

It is also known to provide modular construction wherein walls are formed of complete panels that are connected together. Recently, a number of forms of modular construction have been developed. One such form is disclosed in U.S. Pat. No. 4,630,418 to Degut in which a grooved, four-sided base frame is connected to the ground by steel dowels, for supporting hollow vertical wall panels, bottom tongue portions of the panels being received in the grooves of the frame, the panels being hollow for receiving posts and other components of window and door frames. Transverse edges of the panels have complementary vertical contours for permitting their combined dissembly in juxtaposition at either an angle of 180 degrees or 90 degrees. A chaining is provided atop the panels, the chaining being conformed with the upper portion of the panels, serving as a peripheral reinforcing belt around the panels and permitting direct mounting of roofing elements or superimposed panels thereagainst.

Another type of modular construction is disclosed in U.S. Pat. No. 4,628,650 to Parker in which a panel system includes floor, wall and roof panels for constructing a building. Each panel includes a foam core, with interior and exterior sheathing being placed on opposite sides of the core. The panels also have longitudinally extending channels for receiving joists, studs or rafters.

A further type of modular construction, disclosed in U.S. Pat. No. 3,369,335 to Smith, discloses panels formed of tongue and groove timbers glued together for forming wall panels, each timber being milled for providing a groove along one longitudinal and one transverse end face and a tongue along the opposite longitudinal and transverse end faces. The panels are positioned on a floor plate by a tongue plate on the floor plate and the groove in the transverse end face surfaces of the panel. A ceiling plate is fastened to the top of the wall panels by means of a groove plate that receives the tongue portion of the wall panel.

A number of disadvantages are exhibited in these types of modular construction systems of the prior art, including one or more of the following:

1. It is necessary to have holes drilled in the studs for placement of electrical wiring;

2. The walls can have air cavities which can feed fires; and

3. These systems do not provide adequate anchoring of the panels in that upward and horizontal movement is possible.

Thus there is a need for a building support structure that overcomes the above disadvantages.

SUMMARY

The present invention meets this need by providing a modular construction system that avoids conventional framing studs and headers for doors and windows. In one aspect of the invention, the system includes base means defining a plurality of intersecting, upstanding wall mounting surfaces having a plurality of horizontally spaced fastener attachment points formed thereon; a plurality of rigid, solid panel members that rigidly connect between pairs of the attachment points and extending upwardly therefrom, one side of each panel member being coplanar with a corresponding one of the mounting surfaces; and an elongate plate member rigidly connecting adjacent coplanar pairs of the panel members and extending in line with top peripheral extremities of the panel members.

An adjacent pair of the panel members that are coplanar with an intersecting pair of the mounting surfaces have corresponding ones of the plate members fastened thereto, the plate members being rigidly connected for holding the top portions of panel members coplanar with the mounting surfaces. Preferably adjacent side extremities of the panel members have an interlocking tongue-and-groove cross-sectional configuration between the panel surfaces for rigidly holding each of the side extremities aligned with the other of the extremities in a direction normal to the panel surfaces. Each of the panel members can include a solid bonded plurality of wood laminations. Preferably the wood laminations have a solid thickness of not less than approximately 1.5 inches for structural integrity of the panel members. More preferably, the solid thickness of the wood laminations is approximately 2.25 inches.

Preferably the base means includes a rigid molded foundation, pairs of upstanding metal anchor straps being molded therein and extending upwardly therefrom for defining the mounting surfaces and the attachment points. The attachment points of the anchor straps can be defined by respective mounting holes in each of the anchor straps, the panel members being bolted to corresponding pairs of the anchor straps. The system preferably includes an angle bracket for connecting an adjacent pair of the panel members that are coplanar with an intersecting pair of the mounting surfaces, the bracket being bolted through the panel members to respective ones of the anchor straps. Some of the mounting surfaces can be perimeter mounting surfaces proximate a perimeter edge extremity of the foundation, the anchor straps that define the perimeter mounting surfaces projecting downwardly and inwardly from the perimeter edge extremity into the foundation from proximate the perimeter edge extremity.

The system can include a plurality of joist members supportively connected between a spaced pair of the plate members. The panel members can be first panel members defining corresponding first story walls of the system, corresponding second panel members for second story walls being supported above the first panel members in a slot that is formed between the plate member and a cap member, portions of the plate and cap members extending above the first panel members.

A rigid, thermally insulative insulation panel can be in facing contact with at least one of the panel members, a wall board member being in facing contact with the insulation panel opposite the panel member, the panel member, the insulation panel, and the wall board member forming a substantially voidless wall portion of the system. The system can also include an electrical power circuit having an outlet box rigidly fastened to one of the panel members and protruding the associated insulation panel and a portion of the corresponding wall board member, the box having at least one insulated electrically conductive cable connected thereto for powering the box, a passage for the cable being formed in the insulation panel. A conductive tubular conduit member can extend in the passage, the cable extending within the conduit member. The passage can be formed adjacent the panel member or the wall board member.

DRAWINGS

These and other features, aspects, and advantages of the present invention will become better understood with reference to the following description, appended claims, and accompanying drawings, where:

FIG. 11 is a lateral sectional elevational view showing a portion of the floor portion of the structure of FIG. 10 supporting an upper interior wall portion;

FIG. 12 is a sectional view showing an alternative configuration of the structure of FIG. 11;

FIG. 13 is a bottom oblique perspective view of a roof portion of the structure of FIG. 1;

FIG. 15 is a fragmentary sectional detail view showing an alternative configuration of the apparatus of FIG. 2.

DESCRIPTION

Figure 1:
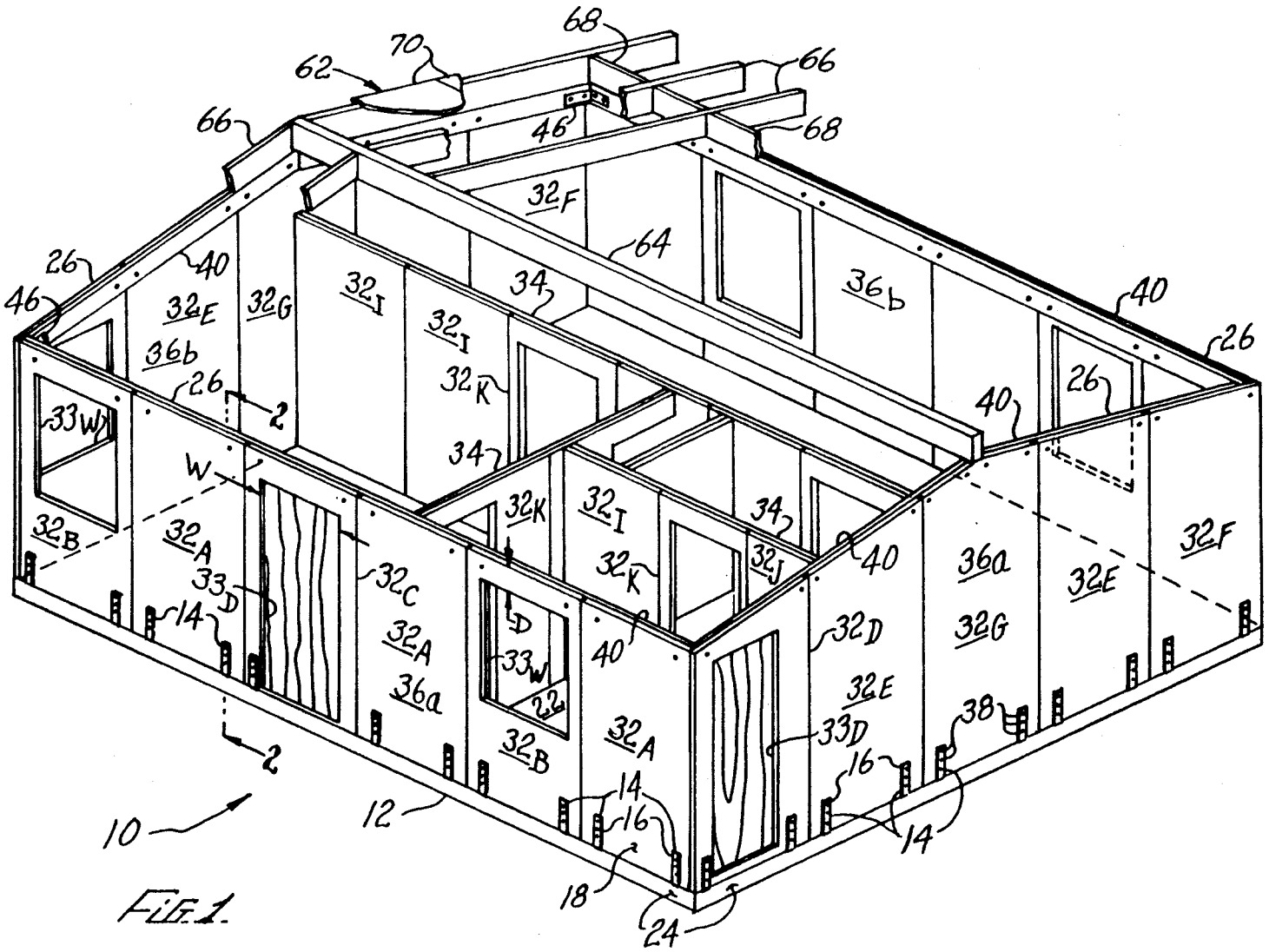
FIG. 1 is a fragmentary elevational perspective view of a building structure according to the present invention.

The present invention is directed to a modular building structure that provides solid wall panels that are particularly receptive to rigid insulation and electrical power wiring. With reference to FIGS. 1-3, 8, and 14 of the drawings, a building structure 10 includes a rigid foundation portion 12 having a plurality of anchor straps 14 cast or molded therein, each of the straps 14 being formed of a high-strength metal such as steel. The anchor straps 14 each have an upstanding mounting portion 16 and a J-shaped base portion 17 extending into the foundation portion 12, the mounting portions 16 defining a plurality of intersecting, vertically oriented wall mounting surfaces 18 according to the present invention, the mounting portions 16 having a vertically spaced plurality of mounting holes 20 formed therein for receiving fasteners as described below.

Figure 2:
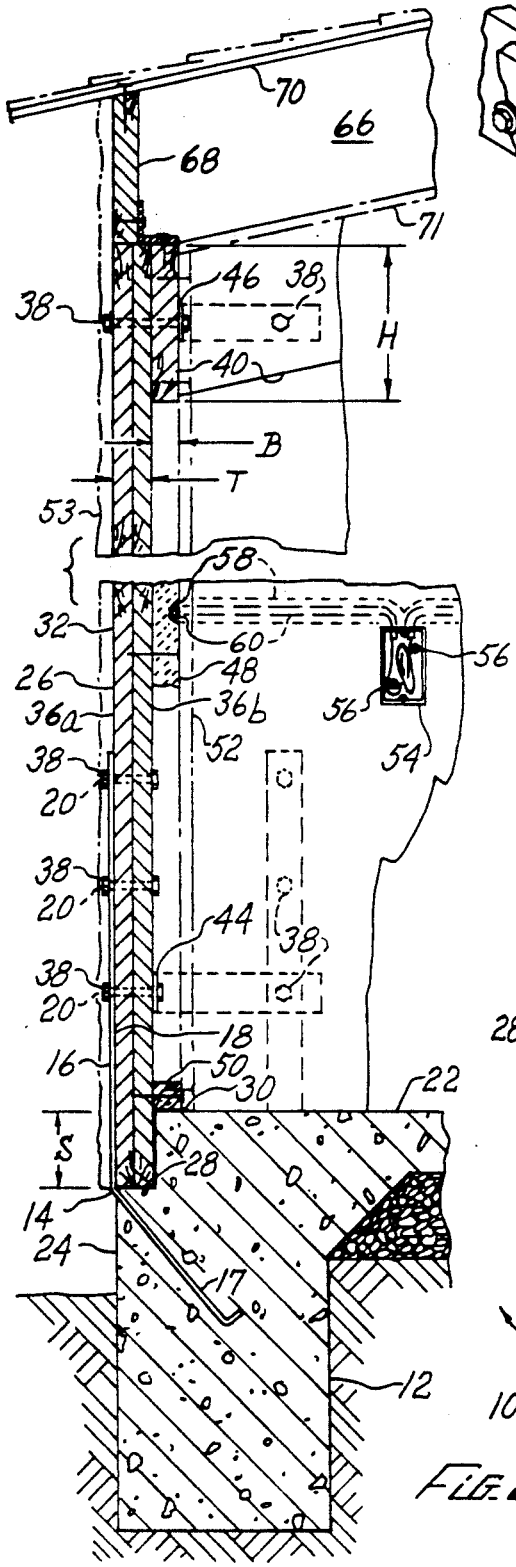
FIG. 2 is a fragmentary elevational detail view of the structure of FIG. 1 on line 2—2 therein.
Figure 3:
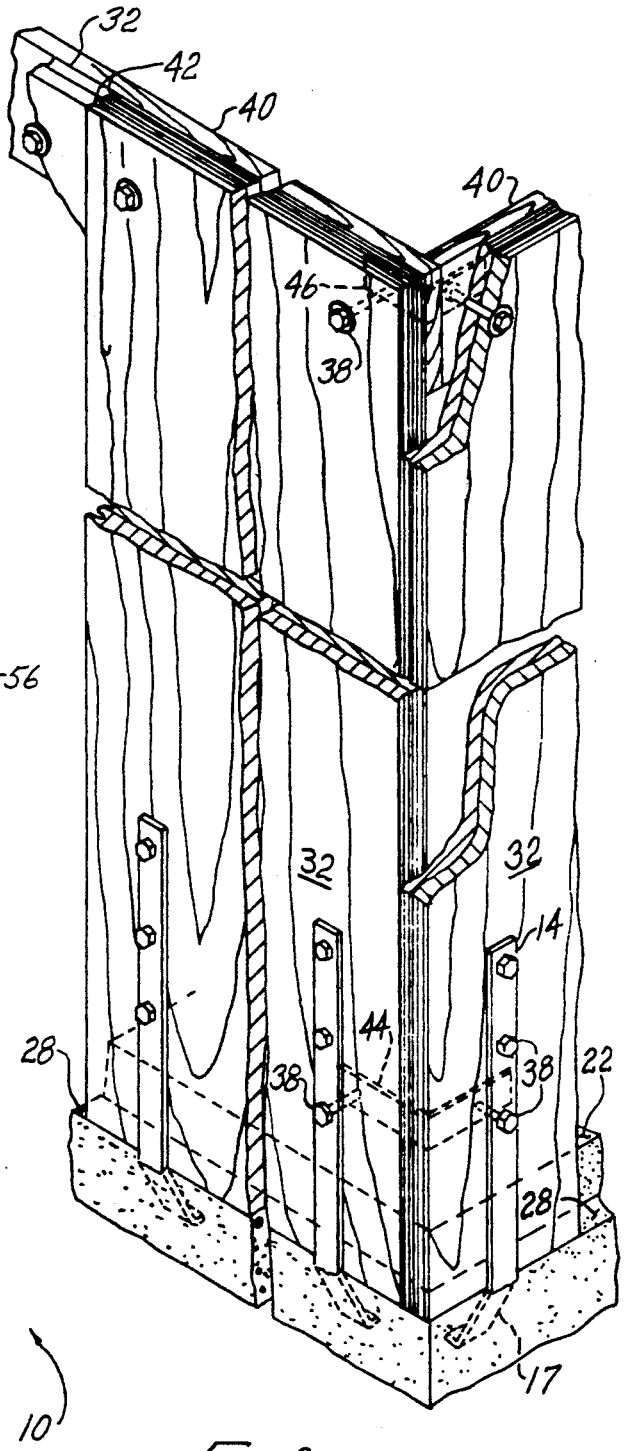
FIG. 3 is a fragmentary elevational perspective view showing a corner portion of the structure of FIG. 1.

As shown in the drawings, the foundation portion 12 has a horizontally disposed first floor surface 22, the foundation portion 12 and the straps 14 functioning as a base of the structure 10. As best shown in FIGS. 2 and 3, a perimeter extremity 24 of the foundation portion 12 can be coplanar with one or more of the wall mounting surfaces 18 for locating corresponding exterior wall portions 26 of the structure 10, the base portion 17 of each of the associated strap members 14 being angled downwardly and inwardly into the foundation portion 12 under the respective wall portions 26. As further shown in FIGS. 2 and 3, an exemplary configuration of the foundation portion 12 is formed with a perimeter shelf surface 28 for supporting the exterior wall portions 26 at a vertical step distance S below the first floor surface 22, a Z-shaped flashing strip 30 covering the shelf surface 28 and a portion of the first floor surface 22 for preventing moisture absorption into the wall portions 26 from the foundation portion 12.

According to the present invention, the exterior wall portions 26 are formed from a plurality of modular wall panels 32, including selected ones of a plain panel $32_A$, a first window panel $32_B$, a first doorway panel $32_C$, a second doorway panel $32_D$, a second gable panel $32_E$, a first gable panel $32_F$, and a center gable panel $32_G$. Similarly, the structure 10 typically includes a plurality of interior wall portions 34 that are formed from selected ones of a plain interior panel $32_I$, and narrow interior panel $32_J$, and an interior doorway panel $32_K$. The door panels $32_C$ and $32_D$ each have a door opening $33_D$ formed therein, and the window panels $32_B$ and $32_H$ each have a window opening $33_W$ formed therein. The wall panels 32 are each formed of a solid laminate having sufficient strength that conventional studs, and headers for door and window openings are not necessary. For this purpose, a suitable material for the panels 32 is a structural grade of laminated fir or similar wood, having a panel thickness T of at least approximately 1.5 inches between opposite panel surfaces 36 of the panel 32, the surfaces 36 being designated first panel surface **36*a* and a second panel surface 36*b*. A preferred configuration of the panels 32 is made from a laminated pair of commercially available plywood sheets 36*a* and 36*b*, each having a thickness of approximately 1.125 inches, the panel thickness T being approximately 2.25 inches. Suitable plywood sheets for use forming the panels 32** are commonly available in nominal sizes of 4 feet wide and either 8 or 9 feet long, the sheets preferably being formed with "tongue and groove" side edges as described further below.

As best shown in FIGS. 1 and 2, the panels 32 of the outside wall portions 26, resting on the portion of the flashing strip 30 supported by the shelf surface 28, are each rigidly fastened to a pair of the anchor straps 14 by a plurality of anchor bolts 38, the bolts 38 protruding corresponding ones of the mounting holes 20 and holding the first panel surfaces 36*a* coplanar with respective ones of the mounting surfaces 18. The panels 32 of the interior wall portions 34 are similarly bolted to corresponding pairs of the strap members 14, the panels 32 extending upwardly from the first floor surface 22. Erection of the panels 32 is facilitated by the anchor straps 14 and the foundation portion 12 above the shelf surface 28 forming a U-shaped slot into which the panels 32 are lowered, the anchor straps 14 and the foundation portion 12 confining the panels 32 in coplanar alignment during fastening thereof by the anchor bolts 38.

Each of the exterior wall portions 26 and interior wall portions 34 has an elongate plate member 40 rigidly fastened against the second panel surfaces 36*b* of the respective panels 32 at an upper extremity thereof, the plate member 40 holding the tops of the panels 32 in coplanar alignment. Adjacent pairs of the panels 32 are also maintained in coplanar alignment by engagement of respective tongue and groove members that extend along contacting edge extremities of the panels 32, as indicated at 42 in FIG. 3. As further shown in FIGS. 2 and 3, adjacent pairs of the panels 32, at intersecting wall portions 26 and/or 34, (the panels 32 being coplanar with an intersecting pair of the mounting surfaces 18) are rigidly connected by a panel angle 44, the respective panels 32 being clamped between ones of the anchor straps 14 and the panel angle 44 by corresponding ones of the anchor bolts 38. The plate members 40 are similarly connected by a plate angle 46, the angle 46 being fastened proximate an end extremity of one of the plate members and to the intersecting plate member 40 by counterparts of the anchor bolts 38, the bolts 38 protruding the angle 46 and the respective panels 32 and plate members 40. The plate members 40, being rigidly connected to the second surfaces 36*b* of the panels 32 such as by further counterparts of the anchor bolts 38, advantageously combine with the window panels $32_B$ and $32_H$, and with the door panels $32_C$, $32_D$ and $32_K$, strengthening the panels 32 to a load carrying capacity sufficient for avoiding the need for conventional header members over the openings 33. This can be understood with reference to a convenient and preferred form of the plate members 40 having a base B and a height H as indicated in FIG. 2, the panels 32 having a depth D above the openings 33, the openings 33 also having a width W as indicated in FIG. 1. Typically, the plate members 40 are made from conventional dimensional "2×10" lumber wherein the base B is 1.5 inches and the height H is 9.5 inches. In one case wherein the panels 32 have a vertical length of 8 feet and the step distance S is 4.5 inches, depth D is approximately 10.5 inches, with allowance for a standard door height of 80 inches and 1 inch for a casing. The composite section, with the thickness T of the panel 32 being 2.25 inches, is 3.75 inches, the section having an average depth of 10 inches. A typical header of conventional construction is 3.5 inches thick. Such a header having the same sectional moment of inertia as the composite section described above would have a depth of approximately 10.5 inches, having more than sufficient strength for spanning an opening width W of approximately 36 inches. Using panels 32 having a width of 48 inches, this leaves approximately 6 inches of the panel 32 on each side of the opening 33. Greater spans are also practical, by increasing the depth D such as by substituting 9-foot high panels 32 or by reducing the step distance S, and/or by increasing the height H and/or the base B of the plate member 40.

The structure 10 of the present invention provides a particularly advantageous support for high-performance rigid insulating panels 48 against the second panel surfaces 36*b* of the panels 32. Suitable thermal insulating panels for use as the panels 48 are commercially available in 4 by 8 foot sheets, in thicknesses ranging from 1 inch to 2.5 inches in half-inch increments. A base strip 50 is fastened to the wall portions 26 at the floor surface 22 for supporting an interior wall board member 52 that extends from proximate the floor surface 22 to the plate member 40, the base strip 50 having a horizontal thickness matching the base B of the plate members 40. A suitable veneer coating such as conventional stucco can be applied to the outsides of the exterior wall portions 26 as indicated at 53 in FIG. 2.

According to the present invention, the thickness of the panels 48 is the same as the base B of the plate members 40 and the base strip 50 for forming a substantially voidless wall configuration of the structure 10. Thus in the exemplary configuration of the structure 10 described above, the insulating panels 48 have a thickness of 1.5 inches, being formed of a closed-cell polymer bonded between a pair of foil layers, and having a thermal rating of R-11.

The insulating panels 48 can be fastened to the second panel surface 36*b* of the panels 32 by conventional means such as by nailing into the panels 32, the process being particularly facilitated by the absence of studs and other framing about the openings 33. The absence of studs and other framing that would otherwise interrupt the insulation also advantageously contributes to efficient thermal insulation of the structure 10.

As further shown in FIG. 2, the present invention facilitates the installation of electrical wiring in the structure 10 by avoiding a need to string the wiring through a multiplicity of drilled holes in conventional studs and other framing members. According to the present invention, the insulating panels 48 are cut through for accepting conventional outlet boxes 54, the boxes 54 being mounted to the second panel surfaces 36*b* of the panels 32 by suitable fasteners 56. Appropriate shallow, trough-shaped grooves 58 are then cut into the panels 48 for receiving insulated electrical cables 60 that extend between the boxes 54, the cables 60 being temporarily supported by duct tape or other means (not shown) until the wall board members 52 are installed, the board members 52 having suitable openings for receiving at least the outer portions of the boxes 54 according to conventional practice. A further advantage of the structure 10 is that there are none of the restrictions regarding the location of the outlet boxes 54 that would otherwise be presented by conventional studs, which dictate specific locations for the boxes by being needed for support of the boxes, and by physically interfering with some box locations.

As shown most clearly in FIGS. 1 and 13, the structure 10 includes a roof portion 62, the roof portion 62 having a ridge member 64 that is supported at opposite ends thereof by a pair of the center gable panels $32_G$. A parallel-spaced plurality of rafters 66 are supportively connected between the ridge member 64 and the tops of opposite outside wall portions 26. A plurality of block members 68 connect adjacent ones of the rafters 64 for preventing the rafters 64 from twisting under load, at least some of the block members resting on the outside wall portions 26 for closing the structure 10. The rafters 66 are covered in a conventional manner by a plurality of sheet members 70 for supporting appropriate roofing materials (not shown). Also shown in FIG. 2 are counterparts of the wall board members 52, designated ceiling panel members 71, fastened to the rafters 66 in a conventional manner. Typically, a suitable insulation material (not shown) is provided on the ceiling panel members 71, between the rafters 66.

Figure 4:
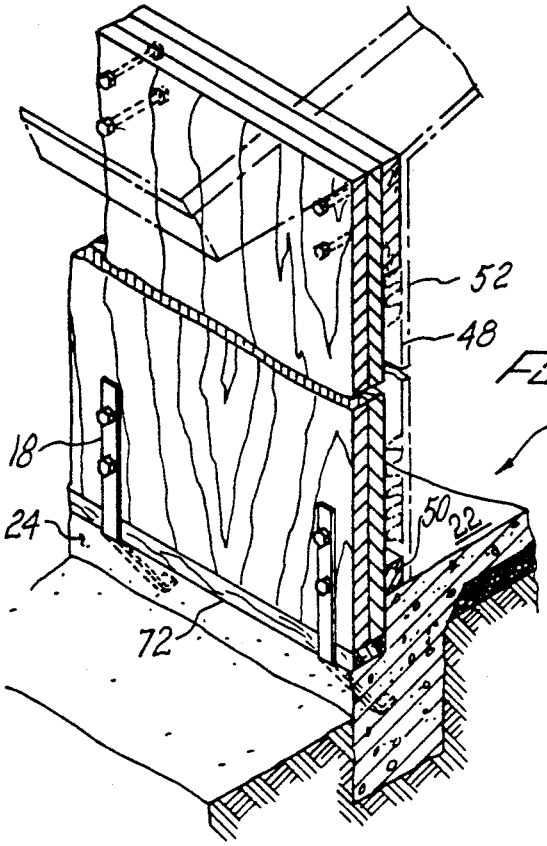
FIG. 4 is a fragmentary elevational perspective view showing an alternative configuration of a portion of the structure of FIG. 1.
Figure 5:
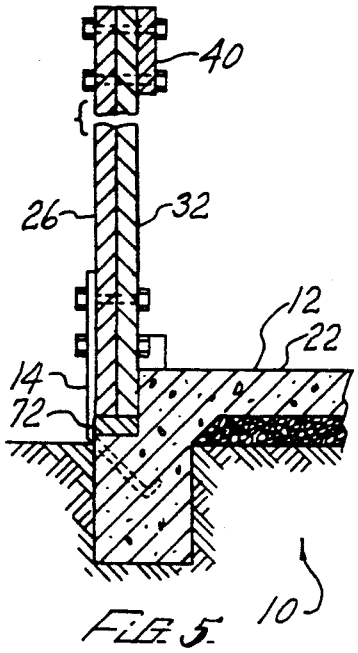
FIG. 5 is a fragmentary sectional elevational view of the structure portion of FIG. 4.

With further reference to FIGS. 4 and 5, an alternative configuration of the structure 10 has the panels 32 of the outside wall portions 26 edge-supported on a base plate 72, the base plate 72 resting on the flashing strip 30 as described above. One effect of the base plate 72 is to increase the depth D of the panels 32 above the openings 33 over that which would otherwise be obtained using the same height of the openings 33 above the floor surface 22, using the same size panels 32 and the same step distance S.

Figure 6:
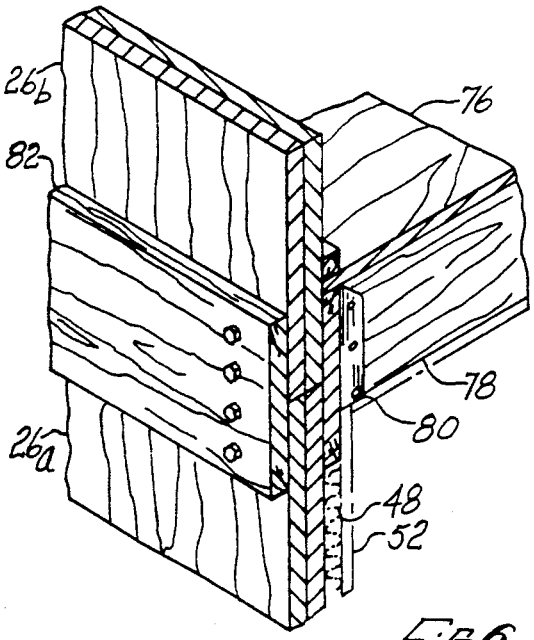
FIG. 6 is an elevational perspective detail view showing an outside wall connection of an elevated floor portion in an alternative configuration of the structure of FIG. 1.
Figure 7:
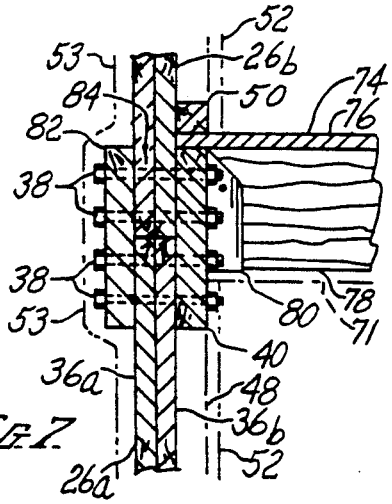
FIG. 7 is an elevational sectional detail view of the structure portion of FIG. 6.

With further reference to FIGS. 6 and 7, another alternative configuration of the structure 10 has an elevated second floor surface 74 that is formed on a floor member 76, the floor member 76 being located generally at an elevation of the tops of the outside wall portions 26, designated first wall portions **26*a*, the floor member 76 being supportively connected to a spaced plurality of joist members 78 that are fastened between spaced ones of the plate members 40 by conventional hangers 78. In the configuration of FIGS. 6 and 7, the plate members 40 are shifted upwardly from the positions shown in FIGS. 1–5, a portion of each plate member 40 extending above the associated first wall portion 26*a*. A counterpart of the plate member, designated cap member 82, is fastened to the first panel surface of the wall portion 26*a*, for example, by the anchor bolts 38 protruding the cap member 82 as well as the plate member 40 and the panel member 32. According to the present invention, the upwardly extending portions of the plate member 40 and the cap member 82 form a U-shaped slot 84 above the first wall portion 26*a* for anchoring a second wall portion 26*b* in alignment above the first wall portion 26*a*. Thus the present invention provides modular two-story as well as single story building construction. Similarly, the foundation portion 12** can be formed at least partially over a sloping site location, the first wall portions functioning as "build-up" supports.

Figure 8:
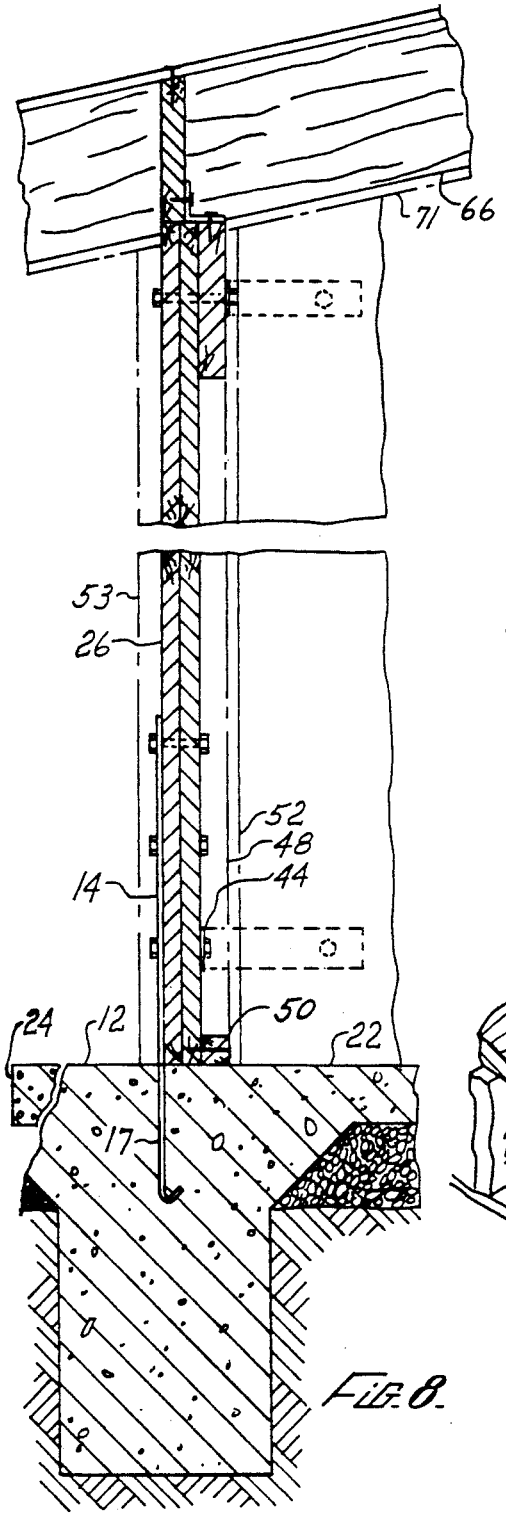
FIG. 8 is a fragmentary sectional elevational view showing an interior wall portion of the structure of FIG. 1.
Figure 9:
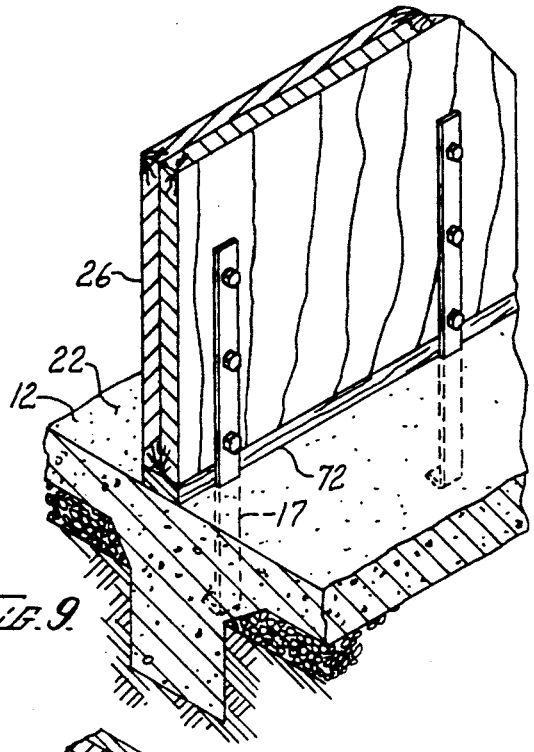
FIG. 9 is an elevational perspective detail view showing an alternative configuration of the wall portion of FIG. 8.

With further reference to FIGS. 8 and 9, the exterior wall portions 26 can have the panels 32 spaced within the perimeter extremity 24, either supported directly on the first floor surface 22 (with appropriate flashing or other suitable means for blocking moisture) as shown in FIG. 8, or on counterparts of the base plate 72 as shown in FIG. 9, the anchor straps 14 having a generally straight configuration, the base portions 17 extending vertically into the foundation portion 12. In these configurations, the step distance S is not a factor. Similarly, the construction shown in FIGS. 8 and 9 is appropriate for the interior wall portions 34.

Figure 10:
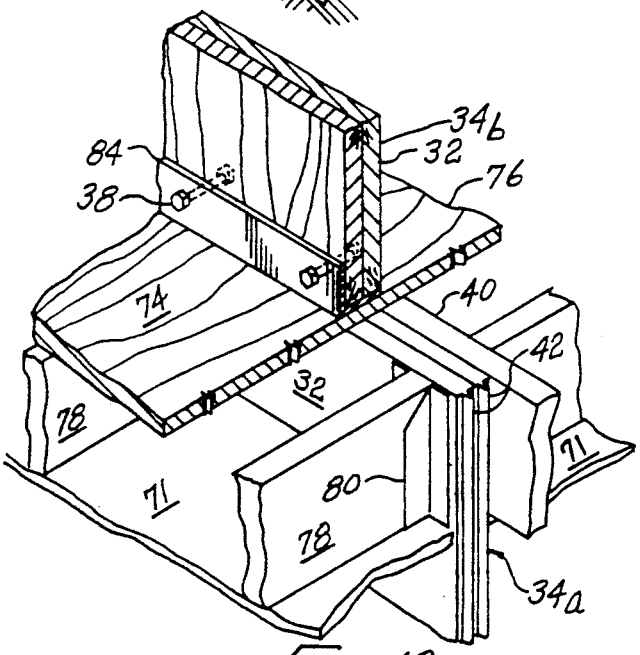
FIG. 10 is an elevational perspective detail view of an interior wall portion connecting an elevated floor portion in an alternative configuration of the structure of FIG. 1.
Figure 14:
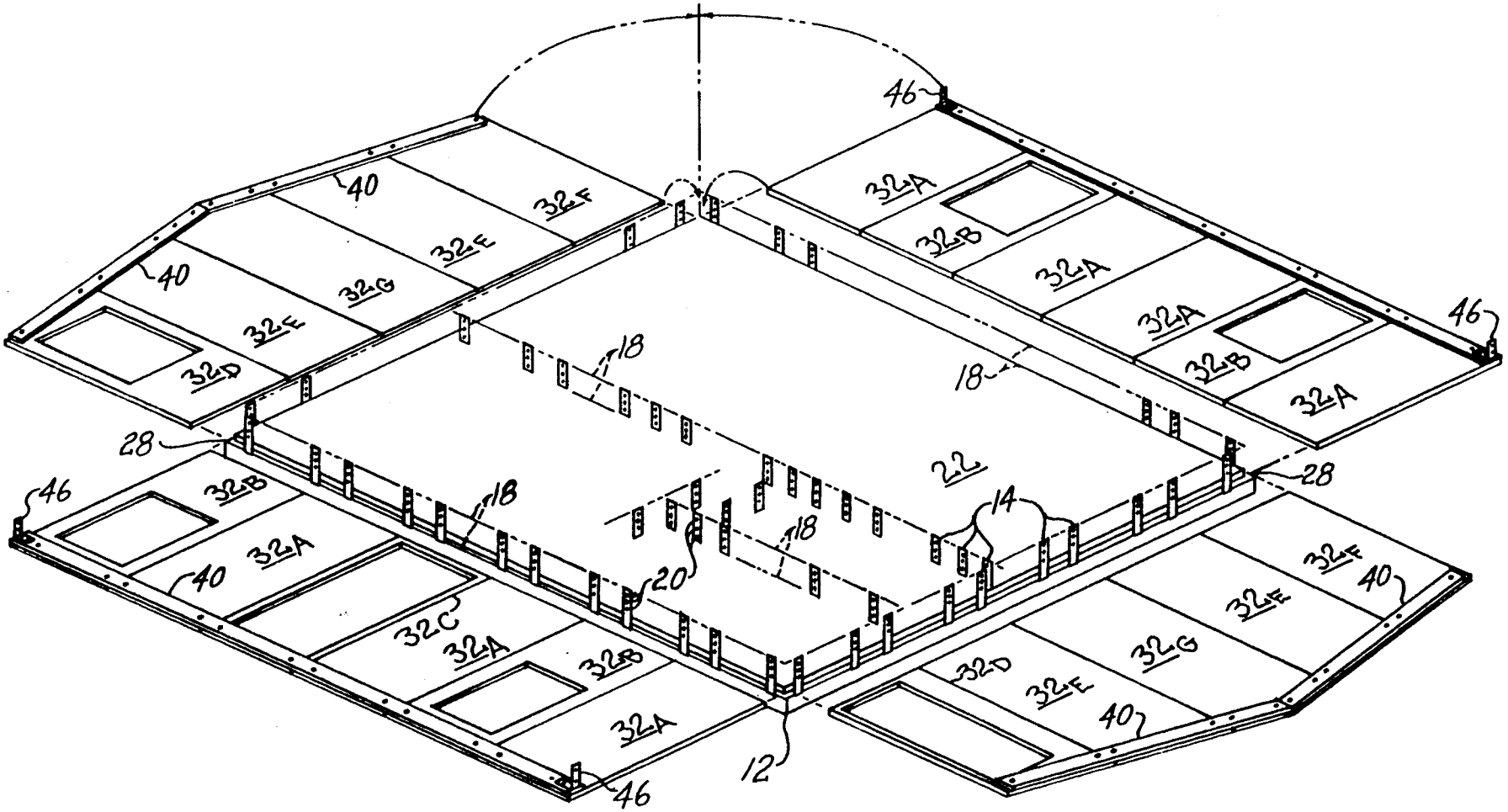
FIG. 14 is an oblique plan perspective view showing the structure of FIG. 1 in a partially completed state.

With further reference to FIG. 10, a first interior wall portion **34*a* of the structure 10 is shown supporting a portion of the floor member 76 and an upper or second story, second interior wall portion 34*b* that extends upwardly from the second floor surface 74. Opposite sides of the first interior wall portion 34*a* have counterparts of the hangers 80 fastened thereto for supporting ends of the joists 87 by the wall portion 34*a* as described above in connection with FIGS. 6 and 7. The panels 32 of the second interior wall portion 34*b* are bolted to an angle member 84 by counterparts of the anchor bolts 38, the angle member 84 being rigidly connected to the first interior wall portion 34*a*** by suitable lag screws (not shown).

With further reference to FIG. 11, the second interior wall portion **34*b* is supportable on the second floor surface 74 where there is no corresponding structure below the wall portion 34*b*, an enlarged counterpart of the joist members 78, designated auxiliary joist 78', being supportively located under the floor member 76. The panels 32 of the wall portion 34*b* are locatingly connected to the floor member 76 by a counterpart of the angle member 84 as described above, the angle member being anchored to the auxiliary joist 78' through the floor member 76 by suitable lag screws 86**.

With further reference to FIG. 12, a modification of the configuration of FIG. 11 has counterparts of the anchor straps 14, designated 14', protruding the floor member 76, the straps 14' being bolted to the auxiliary joist 78' and to the panels 32 by counterparts of the anchor bolts 38.

With further reference to FIG. 15, the groove 58 for the electrical cable 60 can be formed in the insulating panel 48 adjacent (facing) the panel 32 instead of adjacent (facing) the wall board member 52. Further, the cable 60 can be supported within a conductive conduit member 86, the conduit member 86 being supported at intervals by the outlet boxes 54, and by conventional clips 88, the clips 88 being fastened to the panels 32 in a conventional manner as shown in FIG. 15.

The present invention facilitates erection of the structure 10 by providing secure locations of the vertically oriented mounting surfaces 18 above the foundation portion 12 as shown in FIG. 11, wherein the outside wall portions 26 are pre-assembled and positioned for lifting into position against the anchor straps 14. In this intermediate configuration, the plate angles 46 are each fastened to one of the plate members 40 as described above, being fastened to the other associated plate member 40 upon erection of the respective wall portions 26.

Although the present invention has been described in considerable detail with reference to certain preferred versions thereof, other versions are possible. For example, the spacing between the second panel surface **36*b* and the wall board member 52 can be increased for accommodating plumbing in desired locations, such as by widening the base strip 50 and either increasing the base B of the plate member 40 or by adding furring strips to the plate member 40. Preferably the spacing would be increased in half-inch increments for facilitating use of a solid complement of the insulating panels 48, the panels 48 advantageously providing acoustic insulation for the plumbing. Alternatively, some or all of the plumbing can be located between spaced pairs of the wall panels 32. Further, ther first and second panel surfaces 36*a* and 36*b* can be reversed, such that the insulating panels 48 and the associated plate members 40 would be located outside of the panels 32**. Therefore, the spirit and scope of the appended claims should not necessarily be limited to the description of the preferred versions contained herein.

What is claimed is:

1. A modular building structure system comprising:

(i) base means defining a plurality of intersecting, upstanding wall mounting surfaces, each of the mounting surfaces having a plurality of horizontally spaced fastener attachment points formed thereon;

(ii) a plurality of rigid panel members rigidly connected between pairs of the attachment points and extending upwardly therefrom, each panel member being formed of solid bonded plywood laminations and defining a spaced pair of panel surfaces, one of the panel surfaces being coplanar with a corresponding one of the mounting surfaces; and (iii) an elongate plate member rigidly connecting adjacent coplanar pairs of the panel members, the plate member extending in line with top peripheral extremities of the panel members, the solid plywood panel members, in combination with the rigid connections between pairs of the attachment points and the elongate plate member, having sufficient strength that the system does not require studs.

2. The system of claim 1, comprising an adjacent pair of the panel members, the members of the adjacent pair being coplanar with an intersecting pair of the mounting surfaces and having corresponding ones of the plate members fastened thereto, an end extremity of one of the plate members extending to proximate the other plate member, the plate members being rigidly connected for holding the top portions of panel members coplanar with the mounting surfaces.

3. The system of claim 2, wherein adjacent perimeter side extremities of the panel members have an interlocking tongue-and-groove cross-sectional configuration between the panel surfaces for rigidly holding each of the side extremities aligned with the other of the extremities in a direction normal to the panel surfaces when the respective panel members are connected to the attachment points.

4. The system of claim 1, wherein the plywood laminations of the panel members have a solid thickness of not less than approximately 1.5 inches.

5. The system of claim 4, wherein the solid thickness of the laminations is approximately 2.25 inches.

6. The system of claim 1, wherein the base means comprises a rigid molded foundation having pairs of upstanding anchor straps molded therein and extending upwardly therefrom for defining the mounting surfaces and the attachment points, the anchor straps being formed of a high strength metal.

7. The system of claim 6, wherein at least some of the mounting surfaces are perimeter mounting surfaces proximate a perimeter edge extremity of the foundation, the anchor straps defining the perimeter mounting surfaces projecting downwardly and inwardly from the perimeter edge extremity into the foundation from proximate the perimeter edge extremity.

8. The system of claim 6, wherein the attachment points of the anchor straps are defined by respective mounting holes in each of the anchor straps, the panel members being bolted directly to corresponding pairs of the anchor straps.

9. The system of claim 8, further comprising an angle bracket for connecting an adjacent pair of the panel members, the members of the adjacent pair being coplanar with an intersecting pair of the mounting surfaces, a pair of bolts protruding the angle bracket, each of the bolts also protruding one of the panel members and one of the anchor straps.

10. The system of claim 1, comprising a plurality of joist members supportively connected between a spaced pair of the plate members.

11. The system of claim 10, wherein the panel members are first panel members for defining corresponding first story walls of the system, at least some of the plate members facing against one of the panel surfaces and extending upwardly above the top peripheral extremities of the respective first panel members, the system further comprising:

(a) an elongate cap member facing and rigidly connected against the opposite panel surface and extending upwardly above the top peripheral extremities for providing a locating slot above the first panel members; and (b) a plurality of second panel members coplanar with respective ones of the first panel members, the second panel members being locatingly supported in corresponding ones of the locating slots and extending upwardly therefrom, the second panel members defining corresponding second story walls of the system.

12. The system of claim 1, further comprising a rigid, thermally insulative insulation panel in facing contact with at least one of the panel members, and a wall board member in facing contact with the insulation panel opposite the panel member, the panel member, the insulation panel and the wall board member forming a substantially voidless wall portion of the system.

13. The system of claim 12, further comprising an electrical power circuit having an outlet box rigidly fastened to one of the panel members, the box protruding the associated insulation panel and at least a portion of the corresponding wall board member, the box having at least one insulated, electrically conductive cable connected thereto for powering the box, a passage for the cable being formed in the insulation panel.

14. The system of claim 13, further comprising a conductive tubular conduit member extending in the passage, the cable extending within the conduit member.

15. The system of claim 13, wherein the passage is formed adjacent the panel member.

16. The system of claim 13, wherein the passage is formed adjacent the wall board member.

17. A modular building structure system comprising:

(i) base means comprising a rigid foundation having a plurality of upstanding anchor straps molded therein and extending upwardly therefrom for defining a plurality of intersecting, upstanding wall mounting surfaces, the anchor straps being formed of a high strength metal and having respective mounting holes therein for defining a plurality of horizontally spaced fastener attachment points in each of the mounting surfaces;

(ii) a plurality of rigid, solid panel members rigidly bolted between pairs of the attachment points and extending upwardly therefrom, each panel member comprising a solid bonded plurality of wood laminations having a solid thickness of not less than approximately 1.5 inches for effective structural integrity in the absence of framing studs, each panel member defining a spaced pair of panel surfaces, one of the panel surfaces being coplanar with a corresponding one of the mounting surfaces, adjacent perimeter side extremities of the panel members having an interlocking tongue-and-groove cross-sectional configuration between the panel surfaces for rigidly holding each of the side extremities aligned with the other of the extremities in a direction normal to the panel surfaces;

(iii) a plurality of elongate plate members rigidly connecting adjacent coplanar ones of the panel members, the plate members extending in line with top peripheral extremities of the panel members, two of the plate members being connected to respective ones of an intersecting pair of the panel members, an end extremity of one of the plate members extending to proximate the other plate member, the plate members being rigidly connected for holding the top portions of panel members coplanar with the mounting surfaces;

(iv) a rigid, thermally insulative insulation panel in facing contact with at least one of the panel members, and a wall board member in facing contact with the insulation panel opposite the panel member, the panel member, the insulation panel and the wall board member forming a substantially voidless wall portion of the system; and (v) an electrical power circuit having an outlet box rigidly fastened to one of the panel members, the box protruding the associated insulation panel and at least a portion of the corresponding wall board member, the fox having at least one insulated, electrically conductive cable connected thereto for powering the box, a passage for the cable being formed in the insulation panel adjacent one of the wall board member and the panel member.

* * * * *